US010294832B2

(12) United States Patent
Scheiner

(10) Patent No.: US 10,294,832 B2
(45) Date of Patent: May 21, 2019

(54) VARIABLE CAMSHAFT ADJUSTER WITH LOCKING DISC, LOCKING DISC, AND METHOD FOR PRODUCING SAME

(71) Applicant: GKN Sinter Metals Engineering GmbH, Radevormwald (DE)

(72) Inventor: Frowin Scheiner, Bad Kissingen (DE)

(73) Assignee: GKN Sinter Metals Engineering GmbH, Radevormwald (DE)

( * ) Notice: Subject to any disclaimer, the term of this patent is extended or adjusted under 35 U.S.C. 154(b) by 173 days.

(21) Appl. No.: 15/127,264

(22) PCT Filed: Mar. 19, 2015

(86) PCT No.: PCT/EP2015/055847
§ 371 (c)(1),
(2) Date: Sep. 19, 2016

(87) PCT Pub. No.: WO2015/140267
PCT Pub. Date: Sep. 24, 2015

(65) Prior Publication Data

US 2017/0107864 A1 Apr. 20, 2017

(30) Foreign Application Priority Data

Mar. 20, 2014 (DE) ..... 10 2014 003 933

(51) Int. Cl.
*F01L 1/34* (2006.01)
*F01L 1/344* (2006.01)

(52) U.S. Cl.
CPC ... *F01L 1/3442* (2013.01); *F01L 2001/34453* (2013.01); *F01L 2001/34469* (2013.01); *F01L 2103/00* (2013.01)

(58) Field of Classification Search
CPC ..... F01L 1/3442; F01L 2001/34469; F01L 2001/34453; F01L 2103/00
(Continued)

(56) References Cited

U.S. PATENT DOCUMENTS 6,460,496 B2 10/2002 Fukuhara et al.
6,651,600 B1 * 11/2003 Schafer ..... F01L 1/3442 123/90.15

(Continued)

FOREIGN PATENT DOCUMENTS

DE 102005004281 B3 1/2006
DE 102008025506 A1 12/2009

(Continued)

OTHER PUBLICATIONS

PCT International Search Report for corresponding International Application No. PCT/EP2015/055847; dated May 19, 2015.

*Primary Examiner* — Ching Chang
(74) *Attorney, Agent, or Firm* — Quarles & Brady LLP

(57) ABSTRACT

The present invention relates to a variable camshaft adjuster (VVT) for an internal combustion engine with a VVT component, preferably a locking disc, composed of material produced from powder metal with a locking bore, which extends from a first surface of the VVT component, preferably the locking disc, into this, wherein a locking bolt of a variable valve control engages into the locking bore and the locking bore has a connected oil duct which also extends from the first surface into the VVT component and discharges radially into the locking bore, wherein a base of the locking bore has an elevation, preferably in the form of an elevated shoulder which serves as a bearing surface of the locking bolt and the oil duct has a depth which is smaller than that of the locking bore. A VVT component, in particular a locking disc as well as a method for producing the locking disc or the camshaft adjuster are furthermore claimed.

15 Claims, 7 Drawing Sheets

(58) Field of Classification Search
USPC ..... 123/90.15, 90.17
See application file for complete search history.

(56) References Cited

U.S. PATENT DOCUMENTS

| | | | |
|---|---|---|---|
| 6,805,080 | B2 | 10/2004 | Golovatai-Schmidt et al. |
| 7,331,318 | B2 | 2/2008 | Schweizer |
| 2012/0235518 | A1* | 9/2012 | Hentsch et al. |
| 2012/0285407 | A1 | 11/2012 | Watanabe |

FOREIGN PATENT DOCUMENTS

| | | | |
|---|---|---|---|
| EP | 1302630 | A2 | 4/2003 |
| EP | 2492459 | A2 | 8/2012 |
| JP | 2000179310 | A | 6/2000 |

* cited by examiner

VARIABLE CAMSHAFT ADJUSTER WITH LOCKING DISC, LOCKING DISC, AND METHOD FOR PRODUCING SAME

This application represents the U.S. national stage entry of PCT International Application No. PCT/EP2015/055847 filed Mar. 19, 2015, which claims priority to German Patent Application No. 10 2014 003 933.1 filed Mar. 20, 2014, the disclosures of which are incorporated herein by reference in their entirety and for all purposes.

The present invention relates to a variable camshaft adjuster with a VVT component, preferably a locking disc, a locking disc, and in each case a method for producing same.

A wide range of possibilities are known from the prior art as to how a variable camshaft adjustment is enabled. It is known, for example, for this purpose to provide an adjustment in the case of which a locking bolt is moved out of its locking position by means of an oil pressure and as a result a camshaft adjustment is enabled.

The object of the present invention is to provide a camshaft adjustment so that its geometry is adapted to a production process.

Advantageous features, configurations and further developments will become apparent from the following description, the figures and from the claims, wherein individual features from one configuration are not restricted to these. On the contrary, one or more features from one configuration can be joined with one or more features of a different configuration to form further configurations. The formulations of the independent claims also only serve as a first outline of the formulations of the subject matter to be claimed. One or more features of the formulations can therefore be exchanged and also omitted, but also additionally supplemented. The features cited on the basis of a specific exemplary embodiment can also be generalized or used in other exemplary embodiments, in particular applications.

There is proposed a variable camshaft adjuster, to be used in the case of a variable valve operating mechanism, abbreviated below by VVT, for an internal combustion engine with a VVT component, preferably a locking disc, composed of a material produced from powder metal with a locking bore, which extends from a first surface of the VVT component, preferably the locking disc, into this, wherein a locking bolt of a variable valve control engages into the locking bore and the locking bore has a connected oil duct which also extends from the first surface into the VVT component and discharges radially into the locking bore, wherein a base of the locking bore has an elevation, preferably in the form of an elevated shoulder which serves as a bearing surface of the locking bolt and the oil duct has a depth which is smaller than that of the locking bore.

A locking bore configured in such a manner with a radially extending oil duct is preferably used in the case of a locking disc. Such locking bores with radially extending oil duct can, however, also be used as through bores.

The now proposed geometry as well as the following further developments below are advantageous for production from powder metal since it is thus possible to avoid fractures or significant differences in density during production of the green compacts which can otherwise occur, for example, in the case of large cross-sectional differences and transitions at the VVT component. The proposed configuration enables homogenized pressing and reduces the risk of cracks occurring in the green compact during relief of pressure as a result of excessive differences in the geometries. The necessary different die geometries of a press can be shifted in the case of the proposed geometry of the VVT component particularly so that it was possible to significantly reduce a reject rate of green compacts or subsequent VVT components.

The production of the VVT component from powder metal furthermore enables, depending on the variable valve operating mechanism, the possibility of adapting the composition to the respective application. Since each camshaft has a different configuration, different forces and moments also act on these. The interaction of locking bolts with the locking bore is therefore subject to different demands. A targeted adjustment of the powder enables taking account of this together with the density to be produced during pressing and subsequent sintering. According to one configuration, it is possible that a density of at least 6.8 g/cm$^3$, at least 7.1 g/cm$^3$ and preferably 7.4 g/cm$^3$ in the region of the oil duct and/or the locking bore of the VVT component is produced.

The presented variable camshaft adjuster also enables that the VVT component is, for example, calibrated. Calibration can render unnecessary subsequent mechanical machining of surfaces of the VVT component. In particular, calibration enables additional compression in one or more edge regions, for example, of the oil duct and/or the locking bore. In particular, precision in terms of the dimensional stability of the locking bore which lies, for example, in a range of +0.018 in the case of a diameter of the locking bore of 120 mm is also enabled.

It is furthermore proposed that the base of the locking bore is lower than a base of the oil duct by a factor of 2, preferably by the factor 3, in particular by the factor 4 from the first surface. It has been shown that such a depth of the oil duct is sufficient for a required oil flow to and from the locking bore. At the same time, as a result, the oil duct can be produced with approximately uniform compression along its wall and in the base region. The oil duct preferably has a rounded transition from a wall of the oil duct into a base of the oil duct. A wall is preferably running at least approximately perpendicular from the first surface of the VVT component into this. In particular, opposite walls can also run parallel to one another, at least partially. It is, however, also possible that the wall does not sink perpendicularly, but rather slightly obliquely into the VVT component and then forms a transition into the base region of the oil duct. For example, the oil duct can, in one portion, have a wedge-shaped cross-section. The radial extension of the oil duct can be rectilinear, but it can also be rectilinear only at least in one portion. In particular, it is possible that the oil duct also has one or more bends. For example, it can become smaller the further distant it is from the locking bore. It is also possible that the oil duct becomes wider, in particular, however, has different cross-sections along its extension in the VVT component. At a different end of the oil duct, which is arranged, for example, opposite the junction into the locking bore, the oil duct can be rounded. Preferably, both side walls are connected to one another via a rounding at this end. This rounding preferably also extends into the VVT component and also forms a rounded transition into the base region of the oil duct.

A further configuration provides that in the case of the camshaft adjuster in the VVT component the elevation extends arranged centrally from the base of the locking bore towards the first surface.

A further development of the camshaft adjuster has shaped the VVT component in such a manner that the elevation is shoulder-shaped, has a waffle structure or an inverted waffle structure and/or individual surfaces which are independent of one another, between which one or more oil ducts are arranged.

The elevation preferably has a convex-shaped surface. This enables keeping a contact zone between the locking bolts and the elevated portion small. It is furthermore possible as a result to be able to apply an oil pressure on a front side of the locking bolt around the contact zone. For example, this oil pressure can be used for the movement of the locking bolt.

A ring is preferably inserted into the locking bore. It is furthermore preferable that its hardness against abrasive wear is higher than that of the wall of the locking bore itself. As a result, wear of the material of the VVT component can be minimized. For example, the ring can also have a particularly low-friction material, for example, a coating, for example, PTFE. In particular, the ring can be produced from a different material to the VVT component in which the locking bore is located.

The ring is, for example, pressed in. A surface of the ring preferably terminates flush with a surface of the locking bore. This can be, for example, the first surface of the VVT component. It is preferable that a depression is provided on the first surface in which the locking bore is arranged. At the level of this depression, the ring is preferably terminal in a flush manner. For example, this depression can also be used to conduct oil.

A further configuration provides that the VVT component of the camshaft adjuster has a geometry of the locking bore such that the base of the locking bore has, laterally to the edge, at least one elevated portion which serves as a stop surface of a ring inserted into the locking bore. In this manner, according to one configuration, the ring is not placed directly on the base, rather is lifted off therefrom. As a result, oil can flow through below the ring. For example, this oil can flow by means of one or more ducts in the wall of the locking bore. One or more recesses in the wall of the locking bore can also be used for this purpose.

A further configuration provides, for example, that the ring sits on the base. The ring has, for example, one or more punctures or fractures through which oil can flow from one to the other side of the ring. These punctures or fractures correspond, for example, to one or more recesses in the locking bore, along which oil can then also flow.

The variable camshaft adjuster has the locking bolt which penetrates into the locking bore and is moved out of it again. If the locking bolt is in the locking bore, it blocks a relative rotation, but if the locking bolt is raised so far that that it is released from the locking bore, relative rotation is enabled. The locking bolt therefore preferably has at least one bearing for its front face which penetrates into the locking bore. This is preferably the elevated portion already described above. It is furthermore possible that there is in addition to this a further bearing surface for the face side of the locking bolt, for example, if there is a further position in which a blocking of a relative movement is provided. This bearing surface can be present, for example, at a different location of the VVT component, but can also be in contact with the locking bore, for example, by a shared oil connection.

It is furthermore proposed that the elevated portion in the locking bore, on which, for example, the ring to be used sits, is separated from the elevation, preferably by means of one or more oil ducts. The base of the locking bore can also be present between the elevation and the elevated portion.

The VVT component preferably has the locking bore such that it has a form adapted to the locking bolt which is to engage into the locking bore, is preferably formed to be cylindrical or by a crossover of at least two geometrical forms such as circle, polygon, rectangle or other, and, in a wall, has one or more recesses into which the locking bolt engages, wherein a recess preferably coincides with the oil duct. The one or more recesses preferably serve to transport oil between the locking bore and the locking bolt. Guidance of the locking bolt during penetration into and out of the locking bore is then performed via one or more, preferably other portions of the locking bore.

A further configuration of the camshaft adjuster provides that the recess of the locking bore in the VVT component forms with a ring inserted into the VVT component a throughflow duct from the oil duct up to preferably the base of the locking bore.

In the case of a further configuration, it is provided that the locking bore has an at least partially circumferential oil supply which is incorporated into the first surface and forms a transition into the oil duct. As a result, for example, an oil supply to different recesses in the locking bore can be ensured. This is also possible to other oil ducts of the locking bore. In so far as a ring is provided which is inserted into the locking bore, this preferably terminates flush, in particular smoothly with the oil supply. This allows the oil to be distributed into the respective recesses.

A further configuration of the camshaft adjuster provides that the VVT component is formed such that the oil supply and the oil duct have, at least in a respective base region, an at least approximately identical height, preferably have only a small shoulder, in particular form a transition into one another. It is also possible that an offset, in particular a shoulder, lies between the base region of the oil supply and the oil duct.

The locking bore preferably has a form of the base, preferably also of oil ducts preferably at the base, which condition an inflow and outflow speed, wherein hydraulic damping occurs during a movement of the locking bolt in the direction of the base. If the locking bolt is moved into the locking bore, this hydraulic damping prevents an impact with the base or the elevation at the base of the locking bore. The damping can be adjusted by the configuration of the oil-conducting cross-sections by virtue of the fact that as a result an outflow of oil out of the locking bore is restricted.

According to an additional concept of the invention, a VVT component of a camshaft adjuster as described above is therefore proposed and indeed in the form of a locking disc, wherein the locking disc is produced from powder metal. The locking disc comprises the locking bore and the oil duct.

According to a further concept of the invention which can be independent of the configuretion described above but also building thereon, a method for producing a variable camshaft adjuster for an internal combustion engine with a locking bore and an oil duct is proposed, wherein the VVT component is produced from material made of powder metal, wherein a locking bore and an oil duct are formed starting from a first surface of the VVT component, wherein a base of the locking bore is formed deeper in the VVT component than a base of the oil duct.

One further development of the method provides that an end form of the oil duct and/or the locking bore is generated by means of calibration.

According in turn to a further concept of the invention which can also be constructed independently of the above or also thereupon or also in combination, there is proposed a method for producing a locking disc of a variable camshaft adjuster for an internal combustion engine with the following steps:

creating a locking disc by means of metallic powder with creation of a locking bore, pressing-in a wear-resistant bushing into the locking bore during a calibration process.

Further advantageous configurations and features will become apparent from the following figures and the associated description. The individual features which are apparent from the figures and the description are only by way of example and not restricted to the respective configuration. On the contrary, one or more features from one or more figures can be combined with other features from the above description to form further configurations. The features are therefore not indicated to be restrictive rather by way of example. In the figures.

Figure 1:
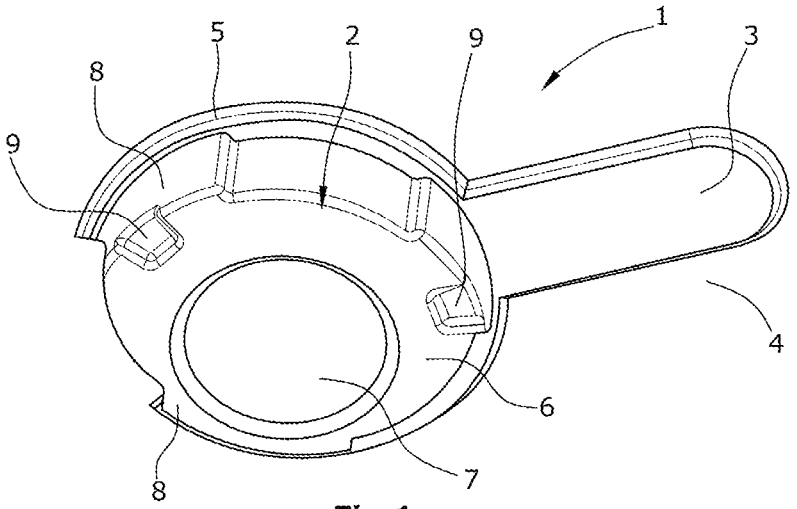
FIG. 1 shows an oblique view of a cut-out of a VVT component.

FIG. 1 shows a VVT component 1 with a locking bore 2 and an oil duct 3 which are incorporated into a first surface 4 of VVT component 1. Oil duct 3 proceeds radially from locking bore 2 and forms a transition into an oil circuit 5 which at least partially surrounds locking bore 2. An elevation 7, which is formed to be shoulder-shaped and circular, is arranged on base 6 on one hand approximately centrally. There are arranged in a wall of the locking bore recesses 8, along which oil can flow if a locking bolt is guided longitudinally in locking bore 2. Elevated portions 9 are furthermore located on base 6. A ring can be inserted on these.

Figure 2:
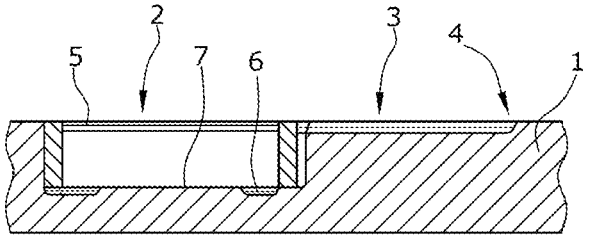
FIG. 2 shows a cross-section of the VVT component from FIG. 1.

FIG. 2 shows a cross-section through FIG. 1. Elevation 7 which extends from the base is preferably composed of the same material as VVT component 1, but can also be composed of a different material. The dimensioning of the individual component parts which are provided for this purpose in each case with their reference signs as from FIG. 1 is also apparent from the cross-section. A preferably powder-metallic inserted ring is discussed in greater detail below.

Figure 3:
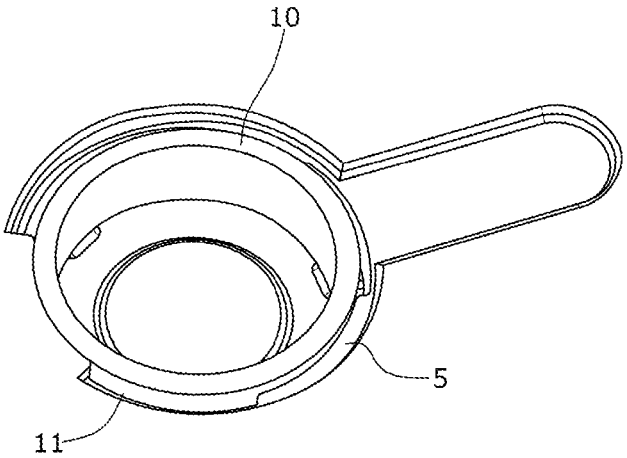
FIG. 3 shows an oblique view of a VVT component with an inserted ring.

FIG. 3 shows FIG. 1 with an inserted ring 10. This can form in each case a gap 11 with recesses 8. Oil can flow through this gap, which oil flows, for example, along oil circuit 5. For this purpose, for example, inserted ring 10 can project beyond oil circuit 5 and form a side wall. It can, however, also terminate flush with the oil circuit.

Figure 4:
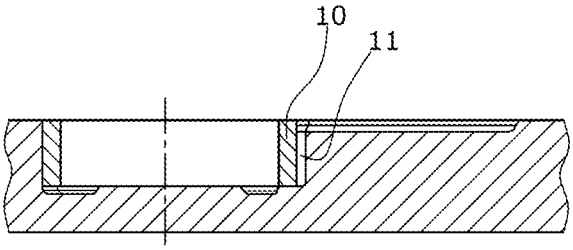
FIG. 4 shows a cross-section through the VVT component from FIG. 3.

FIG. 4 shows a cross-section through VVT component 1 from FIG. 3. Ring 10 and indicated gap 11, which is adjusted by the recesses in the locking bore and the outer contour of ring 10, are represented. In order to support the oil filling, ring 10 can also have one or more locking devices, for example, on the outer contour and on a face-side edge surface.

Figure 5:
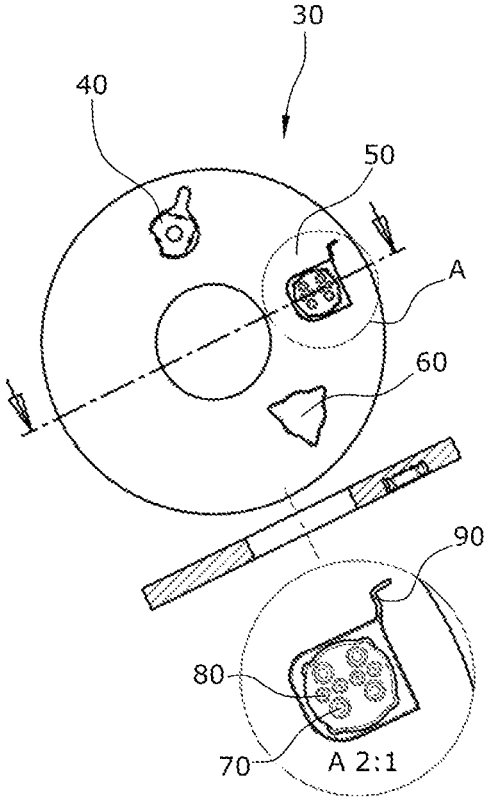
FIG. 5 to FIG. 9 show further configurations.

FIG. 5 shows a further configuration of a VVT component, this time in a larger representation, namely a plan view, a cross-section through the plan view and an enlargement in the case of which one of the existing locking bores is represented in greater detail. In locking disc 30, a first and a second locking bore 40, 50 are represented. While first locking bore 40 can be configured, for example, as is apparent from FIG. 1, second locking bore 50, through which the cross-section also runs, is represented in an enlarged form. Next to an oil duct extending from this geometry and locking bore 50 there are arranged distributed shoulders 70, 80 on the base on which the bolt can be placed, on the other hand the bolt can be guided. Shoulders 70, 80 on the base are preferably elevated portions which can be produced with a corresponding tool form in locking bore 50 during the powder metal production process. Second locking bore 50 is furthermore provided with a different outer contour to, for example, first locking bore 40. The same also applies to the oil-conducting regions which finally form a transition into oil duct 90. In this manner, oil inflow or oil outflow can also be configured in a different manner.

In addition to the rather rounded locking bores, a third locking bore 60 is also represented schematically in the locking disc. This has on one hand a circular configuration which is mixed with a triangular configuration. This leads to the possibility of forming angular corners in the context of a triangular configuration, wherein bulges are incorporated along the axes and are formed to be correspondingly complementary for receiving the bolt. As a result of the formation of the corners, in turn oil guidance can be allowed in the case of which an oil duct otherwise to be guided to the locking bore can be omitted.

Figure 6:
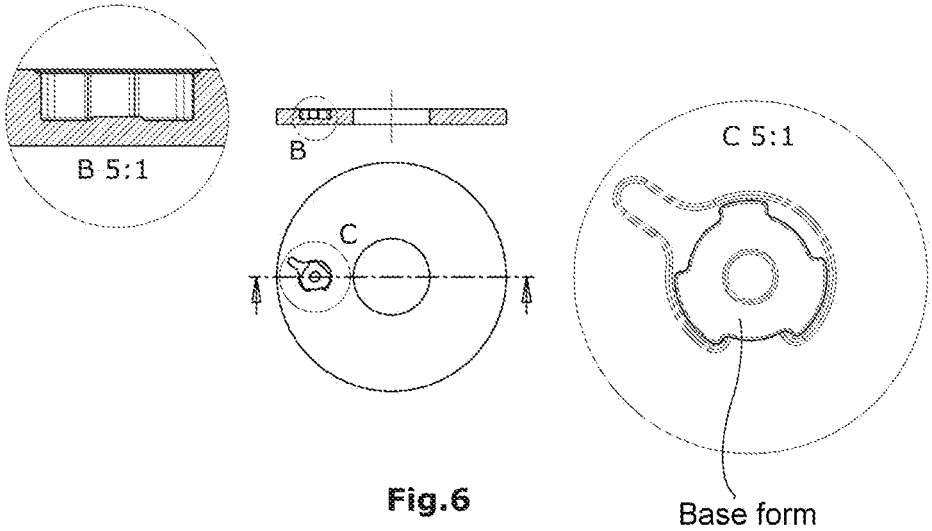

FIG. 6 shows a locking disc as a VVT component, into which in turn a locking bore with oil duct is incorporated, cf. representation C. Enlargement C5.1 indicates a base form, as it can be used, if, for example, the bolt is guided without an additionally introduced ring. To this end, an inner wall configuration of the locking bore is itself complementary to the piston to be introduced. The base form provides on one hand an elevated portion which runs preferably in turn centrally to an axis of the piston to be introduced. The base itself can in turn have convexities which correspond to the required oil guidance and extend laterally to the outside. In cross-section B of FIG. 6, which is represented in an enlarged form in view B5.1, on one hand the oil guide incorporated into the first surface which surrounds the locking bore can be seen. On the other hand, the elevated portion arranged in the central region becomes clearly visible.

Figure 7:
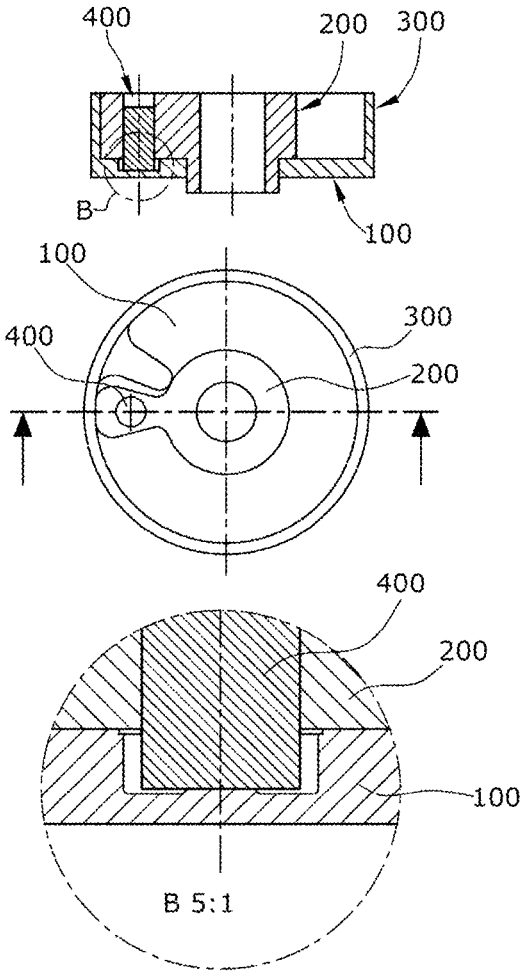

FIG. 7 shows a solution, in the case of which no ring is used. A locking disc 100 is provided into which a rotor 200 is incorporated. A housing 300 sits on locking disc 100. A locking bolt 400 is admitted into a locking position in rotor 200. The locking position is not represented in greater detail in enlargement B5.1. A cross-section which once again makes clear the locking based on the view is also shown. The plan view in turn shows the possible pivoting range of rotor 200, along which it is pivotable in so far as the locking is enabled by corresponding oil pressure and thus achieved raising of locking bolt 400.

Figure 8:
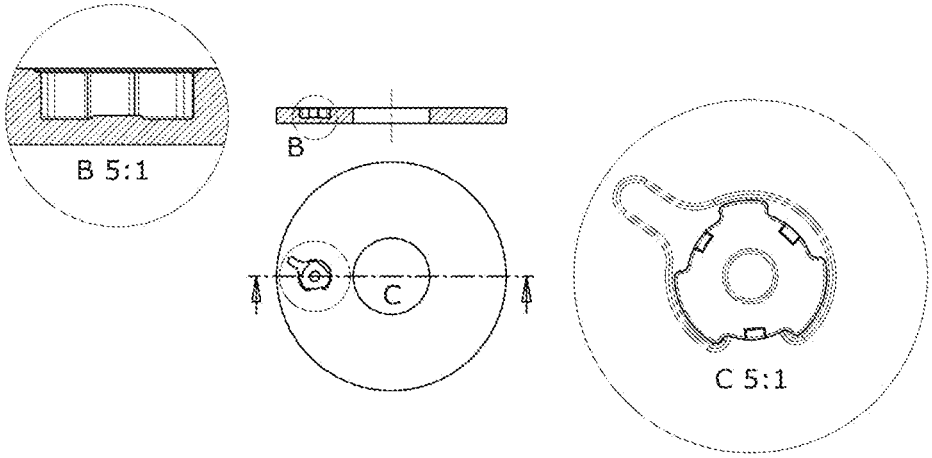

FIG. 8 shows a solution with an incorporated ring. A locking bore which has an elevation at the base is incorporated in the VVT component. Elevated portions arranged laterally thereof are additionally provided on the case, onto which elevated portions the ring can sit. As a result of this, the oil can reach under the locking bolt and generate corresponding compressive force. The base configuration is apparent in greater detail on one hand from plan view C5.1 and from cross-section B5.1.

Figure 9:
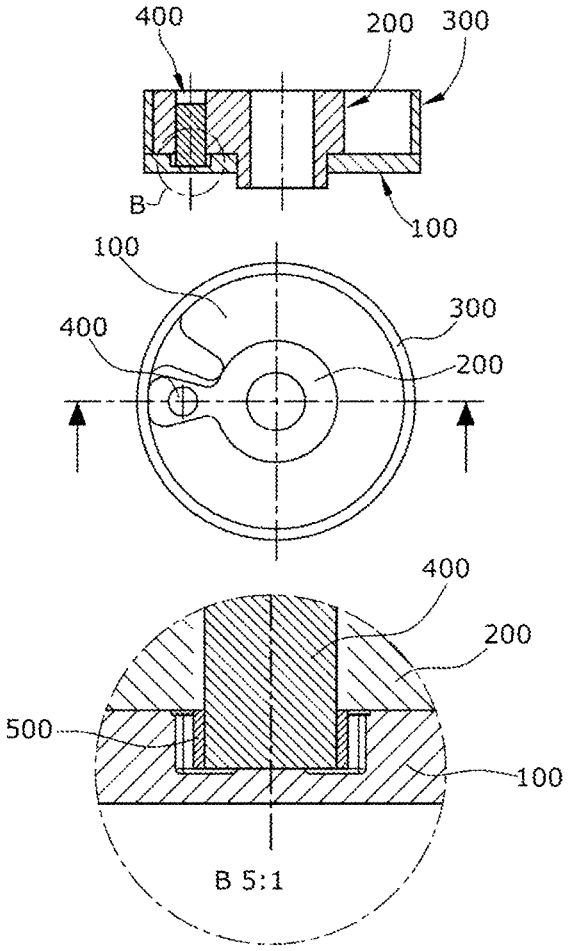

FIG. 9 thus shows with reference to the reference signs which are apparent from FIG. 7 a solution in the case of which a ring is used. A locking disc 100 is in turn apparent from FIG. 9 with a rotor 200, a housing 300 and a locking bolt 400. Additionally, as illustrated from representation B5.1, a ring 500 is provided which is incorporated into the locking bore. In this case, the ring does not sit on the base of the locking bore, rather oil can wash under it, wherein the oil can reach below locking bolt 400.

The further figures show, in simplified representations, further details which can be achieved, for example, on a VVT component as represented above.

The invention claimed is:

1. A variable camshaft adjuster (VVT) for an internal combustion engine with a VVT component composed of material produced from powder metal and having a first surface, a locking bore extending from the first surface, and an oil duct extending from the first surface and connecting to the locking bore that discharges radially into the locking bore, wherein the locking bore being engageable with a locking bolt, wherein a base of the locking bore has an elevation which serves as a bearing surface of the locking bolt, wherein the base of the locking bore is lower than a base of the oil duct at least by a factor of 2 from the first surface, and wherein the oil duct has a depth which is smaller than that of the locking bore.

2. The camshaft adjuster as claimed in claim 1, wherein the elevation extends arranged centrally from the base of the locking bore towards the first surface.

3. The camshaft adjuster as claimed in claim 1, wherein the elevation has a waffle structure or an inverted waffle structure and/or has individual surfaces which are independent of one another, between which one or more oil ducts are arranged.

4. The camshaft adjuster as claimed in claim 1, wherein the elevation has a convex surface.

5. The camshaft adjuster as claimed in claim 1, wherein the base of the locking bore has, to the side of an edge, at least one elevated portion which serves as a stop surface of a ring inserted into the locking bore.

6. The camshaft adjuster as claimed in claim 5, wherein the at least one elevated portion is separated from the elevation.

7. The camshaft adjuster as claimed in claim 1, wherein the locking bore is formed to be cylindrical or by a crossover of at least two geometrical forms such as circle, polygon, rectangle or other, and, in a wall, has one or more recesses into which the locking bolt engages, wherein a recess coincides with the oil duct.

8. The camshaft adjuster as claimed in claim 7, wherein the recess forms with a ring inserted into the VVT component a throughflow duct from the oil duct up to the base of the locking bore.

9. The camshaft adjuster as claimed in claim 1, wherein the locking bore has an at least partially circumferential oil supply which is incorporated into the first surface and forms a transition into the oil duct.

10. The camshaft adjuster as claimed in claim 9, wherein the at least partially circumferential oil supply and the oil duct have, at least in a respective base region, an identical height.

11. The camshaft adjuster as claimed in claim 1, wherein a form of the base and of oil ducts condition an inflow and outflow speed, wherein hydraulic damping occurs during a movement of the locking bolt in a direction of the base.

12. The camshaft adjuster as claimed in claim 1, wherein the VVT component comprises a locking disc.

13. The camshaft adjuster as claimed in claim 1, wherein the elevation is a shoulder.

14. A method for producing a variable camshaft adjuster (VVT) for an internal combustion engine with a VVT component, wherein the VVT component comprises a first surface, a locking bore, and an oil duct, wherein the VVT component is produced from powder metal material, wherein the locking bore and the oil duct are formed starting from the first surface of the VVT component, wherein a base of the locking bore is lower than a base of the oil duct at least by a factor of 2 from the first surface, and wherein a base of the locking bore is formed deeper in the VVT component than a base of the oil duct.

15. The method as claimed in claim 14, wherein an end form of the oil duct and/or the locking bore is generated by means of calibration.

* * * * *